United States Patent [19]

White

[11] Patent Number: 4,608,773

[45] Date of Patent: Sep. 2, 1986

[54] KIOSK DISPLAY UNIT

[75] Inventor: O. Timothy White, Carnesville, Ga.

[73] Assignee: Royston Corporation, Royston, Ga.

[21] Appl. No.: 701,773

[22] Filed: Feb. 14, 1985

[51] Int. Cl.[4] ..... G09F 15/00

[52] U.S. Cl. ..... 40/606; 40/10 R; 40/16.4; 40/152.1

[58] Field of Search ..... 40/10 R, 16 R, 14.4, 40/152.1, 606, 607

[56] References Cited

U.S. PATENT DOCUMENTS

| | | | |
|---|---|---|---|
| D. 106,502 | 10/1937 | Fine . | |
| D. 109,166 | 4/1938 | Tilton et al. . | |
| 1,287,921 | 12/1918 | Duell | 40/606 |
| 2,258,560 | 10/1941 | Trunzer | 40/606 |
| 2,372,387 | 3/1945 | Morin, Jr. et al. | 40/145 |
| 3,517,905 | 6/1970 | Nestegard | 248/469 |
| 3,952,437 | 4/1976 | Mitchell | 40/152.1 |
| 3,975,850 | 8/1976 | Giame | 40/606 |
| 4,326,349 | 4/1982 | Daugherty | 40/16 |
| 4,377,049 | 3/1983 | Simon et al. | 40/16.4 |

*Primary Examiner*—Gene Mancene
*Assistant Examiner*—Wenceslao J. Contreras
*Attorney, Agent, or Firm*—Howson and Howson

[57] ABSTRACT

This kiosk display unit comprises a pedestal consisting of three identical sheet metal panels which are secured together, to form a structure closed upon itself, by interengaging hook tabs and tab-receiving openings in flanges along edges of the panels. Because the panels are identical, to engage second and third panels to opposite edges of a first panel, the second panel must be moved relative to the first panel in one direction and the third panel must be moved relative to the first panel in the opposite direction. To engage the second and third panels with each other, a twisting movement is imparted to the assembly to allow the hook tabs and openings of the second and third tabs to become engaged with each other. Trapezoidal tabs and openings are used to facilitate entry of the tabs into the openings when the structure is twisted.

The display unit also comprises a closed display section comprising three panels and three posts. Each post receives edges of two panels and retains the panels by the engagement of the outside face of each panel with a retaining flange of the post and by the engagement of a tongue of the post with a groove, on the inside face of each panel, extending parallel to the panel edges and spaced therefrom by a short distance.

21 Claims, 11 Drawing Figures

KIOSK DISPLAY UNIT

BRIEF SUMMARY OF THE INVENTION

This invention relates to a free-standing kiosk display unit, and more particularly to components of the display unit, specifically a rigid sheet metal structural element serving as a pedestal, and a post-and-panel structure serving as a display section.

A kiosk display unit is an upright unit which is accessible from all sides. This invention is primarily concerned with a kiosk display unit intended for displaying printed matter such as advertising or other printed information, posters, signs and the like. Kiosk display units have the advantage that they can be designed to stand by themselves, and are capable of displaying information which is visible from all horizontal directions. They are especially desirable for use in locations where floor space is available, but where wall space is not. For example, kiosk display units can be used to display advertising in aisles of supermarkets, where ordinarily all of the available wall space is taken up by shelving. Kiosk display units have the further advantage that they can be readily moved from place to place.

Prior display units of the kiosk type were structurally complex, requiring numerous different parts, and numerous fasteners. They were therefore both expensive to manufacture and time-consuming to assemble. In general, reductions in cost in the past have resulted in sacrifices in strength and stability in these kiosk units.

The principal objects of this invention are to provide a kiosk display unit which is inexpensive to manufacture, easily and rapidly assembled by unskilled personnel, and both strong and stable; to provide a kiosk display unit which is structurally simple, utilizing a small number of fasteners, and a minimum of different parts; and also to provide a kiosk display unit which is both light in weight and pleasing in appearance.

The principal features of the invention which result in the achievement of the foregoing objects are the following. First, the display unit utilizes a sheet metal base pedestal which comprises a plurality of identical panels, rigidly held together without fasteners. Securing the identical panels of the pedestal together without fasteners is accomplished by providing flanges having interengageable openings and hook tabs, and by connecting the panels together to form a closed hollow structure. The final step in the assembly of the closed hollow pedestal structure consists of applying a twisting force to the structure so that when the last two flanges to be engaged are brought together, their hook tabs can enter their corresponding openings. The twisting force is then released, and the hook tabs and openings are locked together, forming a rigid, hollow pedestal structure consisting of a plurality of identical panels, and requiring no fasteners. The rigid hollow structure has uses other than as a pedestal for kiosk display unit.

Another important feature of the invention which enables it to achieve the above-mentioned objects is the structure of the display unit above the pedestal, which includes panels and corner posts. Corner posts are specially constructed with panel-retaining surfaces and tongues. The panels are provided with grooves to receive the tongues of the post elements. When all the posts and panels are secured together, a rigid structure results.

Still another feature resides in the post construction. Each post consists of two identical parts, each of which is simple, and easily fabricated. These two parts fit together securely to form a rigid corner post.

The use of identical parts, including identical post elements and identical pedestal panels simplifies manufacture, reduces the likelihood of shipping and packing errors, and facilitates assembly of the kiosk display unit.

Various other significant features of the invention, as well as other objects and advantages of the invention will appear from the following detailed description when read in conjunction with the drawings.

DETAILED DESCRIPTION

Figure 1:
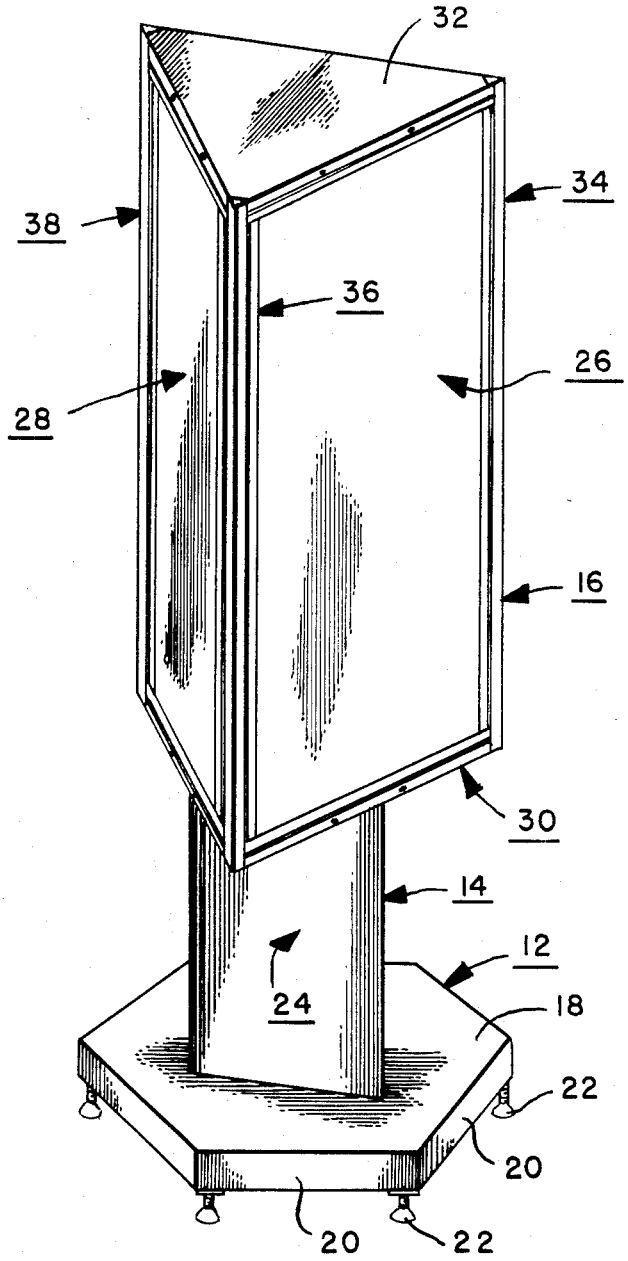
FIG. 1 is a perspective view of a kiosk display unit in accordance with the invention.

The kiosk display unit in accordance with the invention comprises a base 12, a pedestal 14, and a display section 16. The different parts of the unit can be provided in several different configurations. However, the unit illustrated in FIG. 1 has a three-sided display unit, a three-sided pedestal, and a six-sided base.

Base 12 has a hexagonal planar top, and six rectangular sides 20. For levelling the display unit, vertically adjustable feet 22 at the corners of the base are threaded into threaded nuts affixed to the underside of the base.

Panel 24 is one of three identical panels of the pedestal. The pedestal has a triangular configuration, and is disposed symmetrically with respect to the hexagonal top of the base. It is fastened to the top of the base by sheet metal screws which extend upwardly through holes in the top of the base and into holes in inwardly projecting flanges (not shown in FIG. 1) at the bottom of pedestal 14.

Display section 16 comprises three identical panels, two of which are seen in FIG. 1 at 26 and 28. These panels can be made from composition board or any other suitable rigid material. Display section 16 has a triangular bottom panel 30 which rests on pedestal 14 and is fastened thereto by sheet metal screws (not shown). A similar triangular panel 32 is provided at the top of the display section. Sheet metal posts 34, 36 and 38 are provided at the corners of the display section. Each of these posts consists of two identical parts, and is constructed in such a way as to retain the panels securely by cooperation of tongues of the posts with vertically extending grooves formed near the edges of the panels on the inside faces thereof.

Figure 2:
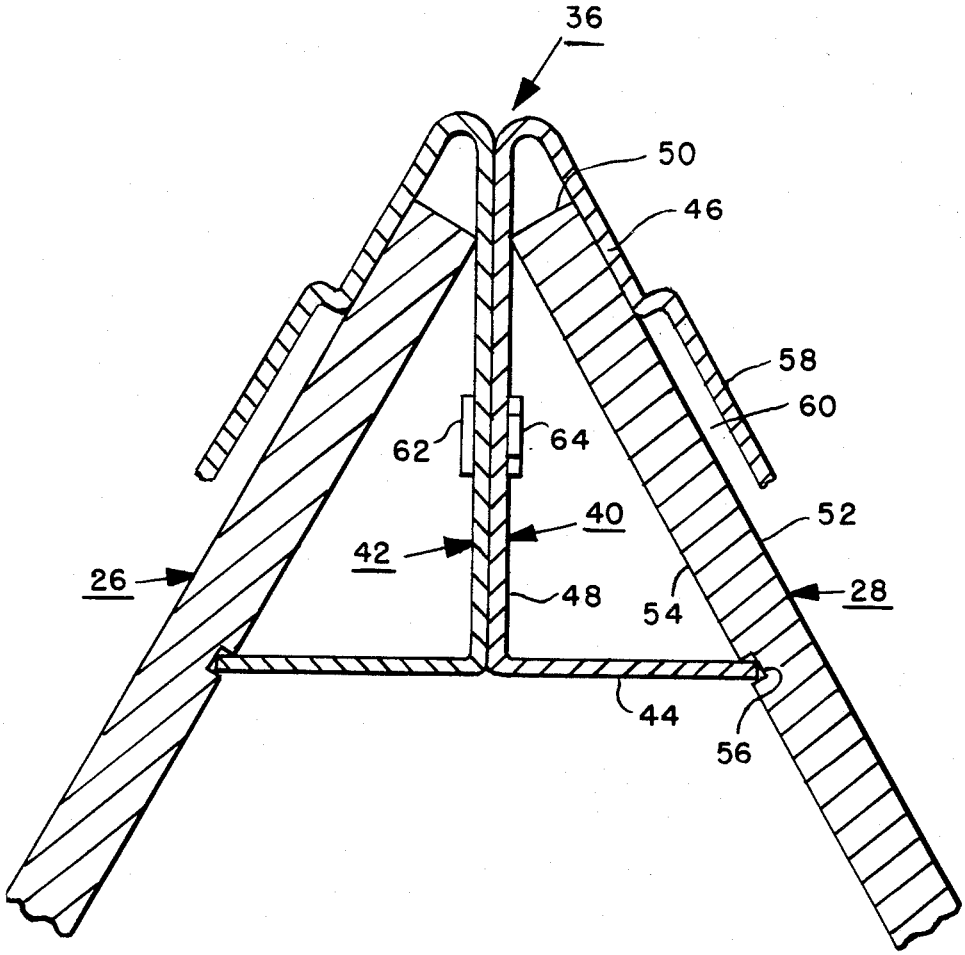
FIG. 2 is a fragmentary horizontal section showing the details of a corner post of the display section of the unit and illustrating the manner in which the corner post cooperates with two of the panels of the display section.

The details of the post and panel interconnections are seen in FIG. 2, which shows post 36 consisting of identical parts 40 and 42 secured together in back-to-back relationship. Post element 40 is a unitary sheet metal element having an elongated tongue 44 and a vertically elongated panel-retaining element 46 interconnected by a web or connecting element 48. Panel-retaining element 46 is disposed at a 30° angle with respect to connecting element 48 to provide a pocket to receive edge 50 of panel 28. Outside face 52 of panel 28 rests against the inside face of panel-retaining element 46. Preferably, but not necessarily, edge 50 of the panel reaches into the pocket to the extent that it contacts connecting element 40.

Inside face 54 of panel 28 has a groove 56, which extends parallel to edge 50, and is spaced therefrom by a distance such that tongue 44 can enter groove 56 while face 52 of the panel rests against the inside face of retaining element 46 at a location closer to edge 50 than the distance between edge 50 and groove 56. The engagement of groove 56 with tongue 44 prevents panel 28 from sliding out of post element 40 in a horizontal direction parallel to the faces of panel 28. Panel 26 is held in post element 42 in a similar manner, and similar post-panel connections exist at each of the three corners of the display section. The other post-panel connections (not shown in FIG. 2) prevent panel 28 from rotating about a vertical axis, either at edge 50, or at a point between edge 50 and groove 56. Consequently, groove 56 is maintained in engagement with the edge of tongue 44.

The angle between tongue 44 and connecting element 48 is not critical. However, the width of the interconnecting element and the angle between the interconnecting element and the tongue should be such that the tongue meets the panel at a steep angle so that the tongue does not tend to be cammed out of the groove in the panel.

Sheet metal strip 58 is provided as a continuation of panel-retaining element 46. Strip 58 is spaced outwardly from face 52 of panel 28 by a short distance to provide a channel 60 for retaining sheet material, e.g. posters and the like, against face 52 of the panel.

The 30° angle between connecting element 40 and panel-retaining element 46 results in the positioning of connecting element 40 away from the inside face 54 of the panel and at a location at which it is situated in back-to-back relationship with a corresponding connecting element of post element 42. These connecting elements, in back-to-back relationship, bisect the 60° angle formed between the inner faces of panels 26 and 28. Hook tab 62, formed as an integral part of connecting element 48, extends through a hole in the corresponding connecting element of post element 42, and then extends downwardly, locking the two post elements together. A similar, upwardly extending hook tab 64 of post element 42 extends through a hole in connecting element 48, and also serves to lock the two post elements together. Several such tab and hole combinations are provided along the lengths of the post elements. Details of the hole and hook tab configurations are seen in FIG. 3.

Figure 3:
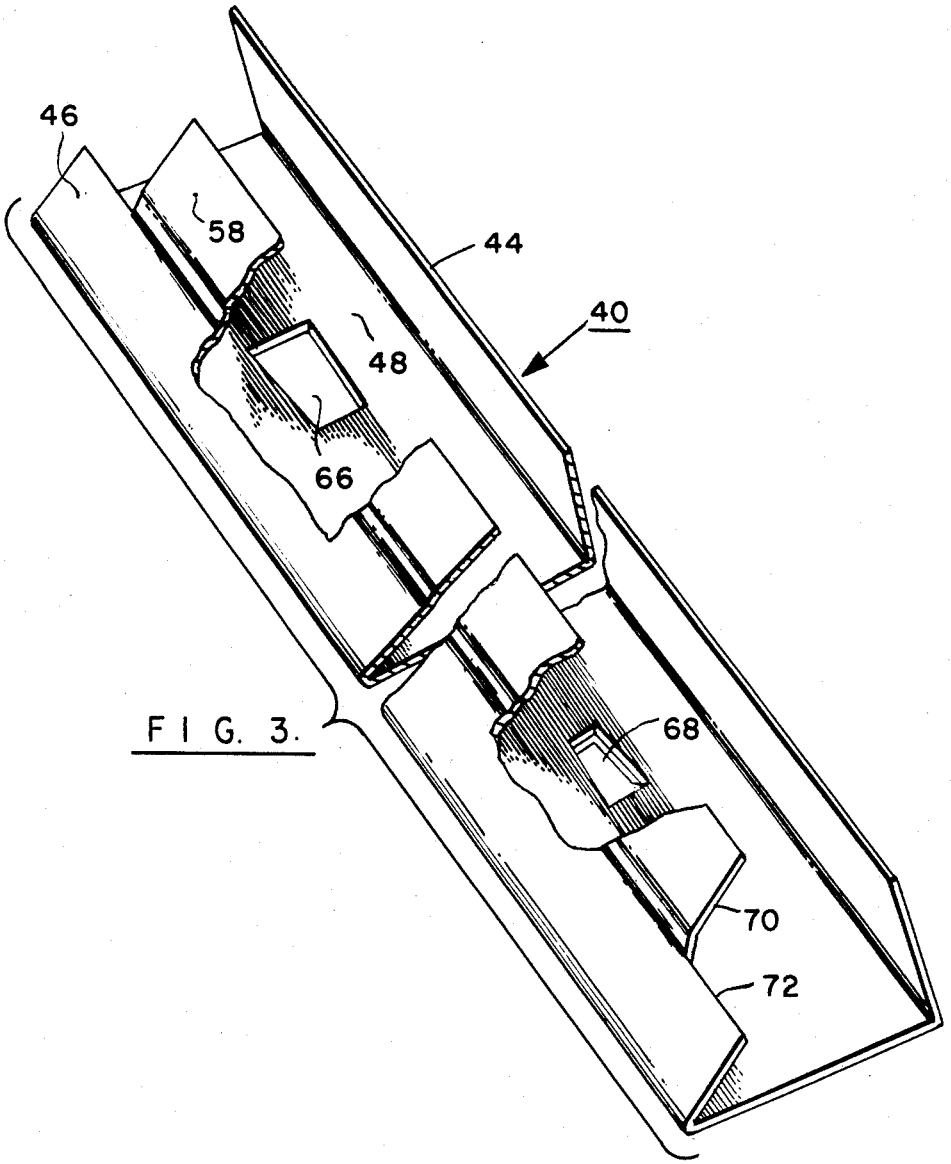
FIG. 3 is a perspective, partially broken away, of one element of a two-element corner post of the display section.

Referring to FIG. 3, post element 40 is provided near one of its ends with a trapezoidally shaped hole 66, which is tapered in the direction toward the major part of the post element. Near the opposite end, the post elememt is provided with a struck-out hook tab 68, which is also generally trapezoidal in shape, and which is tapered toward the opposite end of the post element. In a typical post, there are three openings corresponding to opening 66 near one end of the post, and three hook tabs corresponding to hook tab 68 near the opposite end of the post. These hook tabs and openings are designed to cooperate with each other so that two identical post elements can be fastened together. Fastening is accomplished by causing the hook tabs of each post element to enter the trapezoidal openings of the other post element, and then sliding the posts relative to each other in a longitudinal direction to cause the hook tabs to overlap the connecting webs of the post elements. Preferably, the wide ends of the trapezoidal tabs are nearly equal in width to the narrow ends of the trapezoidal holes. This prevents relative lateral movement of the post elements when they are together. The trapezoidal shapes of the hook tabs and the holes facilitates entry of the tabs into the holes during assembly. The hook tabs, rather than extending toward the major part of the post element, can extend in the opposite direction, i.e. toward the near end of the post element. If the hook tabs are formed in this way, the openings would be tapered in the opposite direction from the direction of tapering shown in FIG. 3. The number of hook tabs and tapered openings may be varied depending on the length of the post.

In FIG. 3, sheet retaining strip 58 terminates at edge 70, which is spaced from the adjacent end of the post element by a short distance to provide a clearance space delimited by edge 70 of strip 58 and edge 72 of panel-retaining element 46. A similar clearance space is formed at the opposite end of the post element. These clearance spaces are provided to accommodate the triangular top and bottom elements of the display section.

Figure 4:
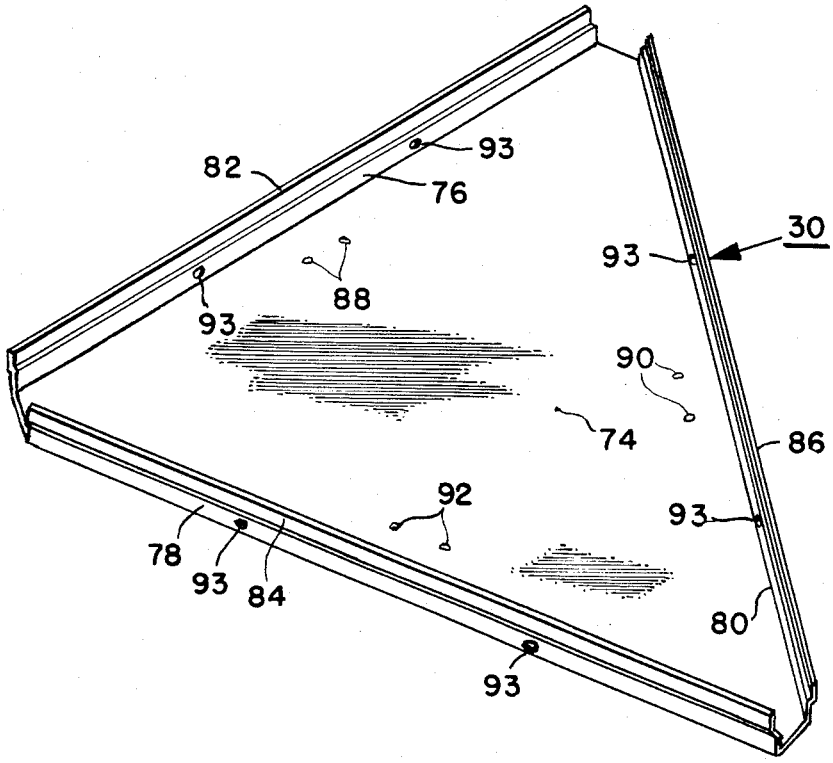
FIG. 4 is a perspective view of a triangular bottom panel for the display section.
Figure 7:
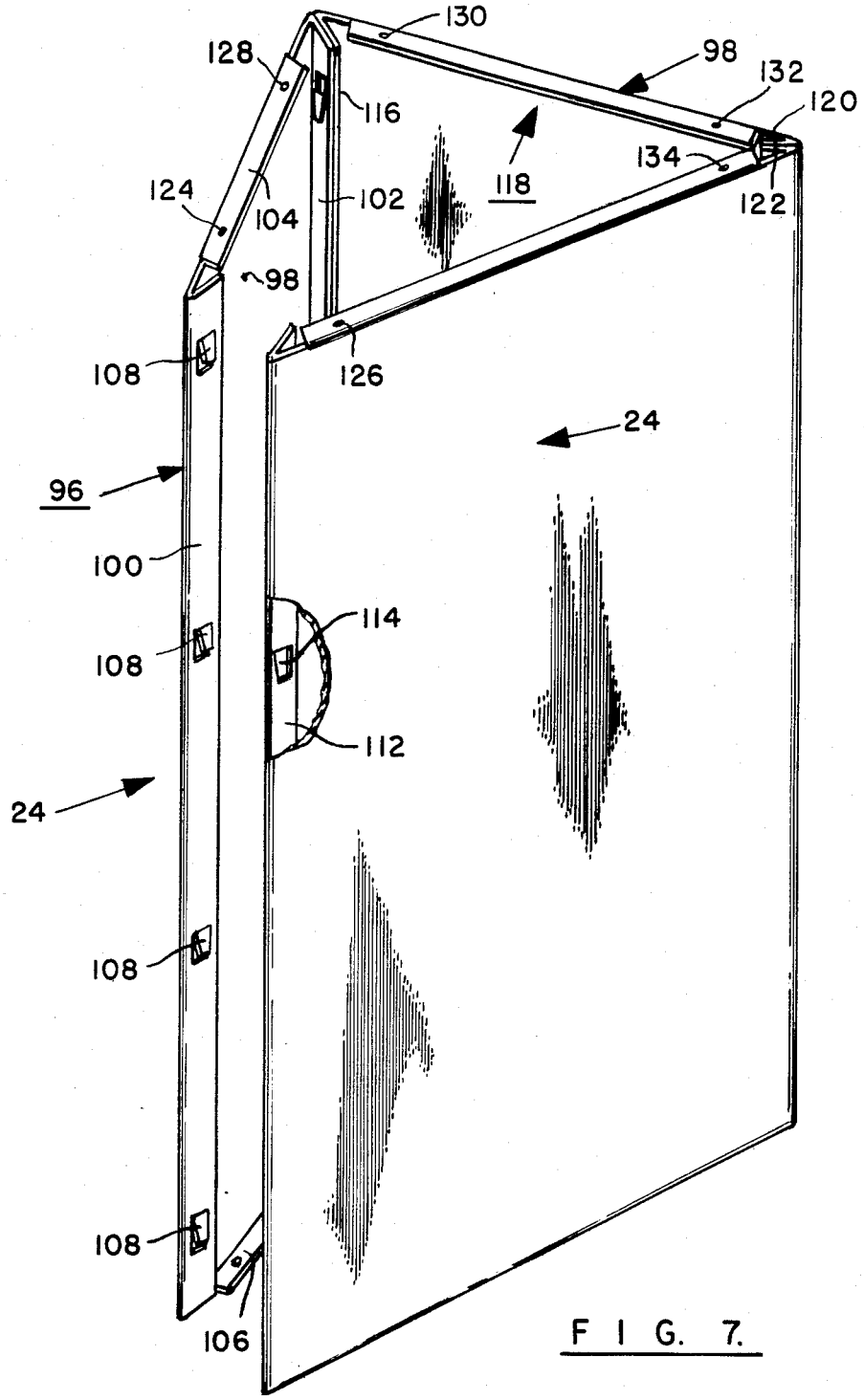
FIG. 7 is a perspective view of a three-panel pedestal partially assembled.

Bottom element 30 is shown in FIG. 4. It comprises a panel 74 which is in the shape of a triangle with its corners cut off. Flanges 76, 78 and 80 are provided along the edges of panel 74. These flanges have outwardly offset sheet retaining strips 82, 84 and 86 respectively. Pairs of holes are provided at 88, 90 and 92 to secure panel 74 to the pedestal of the display unit. Sheet metal screws extend through these holes into holes provided on flanges at the top of the pedestal, which holes are seen in FIG. 7. Holes 93 are provided in flanges 76, 78 and 80 for screws (not shown) which are used to secure panels, such as panels 26 and 28 (FIG. 1), to the top and bottom elements 30 and 32 of the display unit. Top element 32 (FIG. 1) is substantially identical to bottom element 30, however, it need not have holes corresponding to holes 88, 90 and 92.

Figure 5:
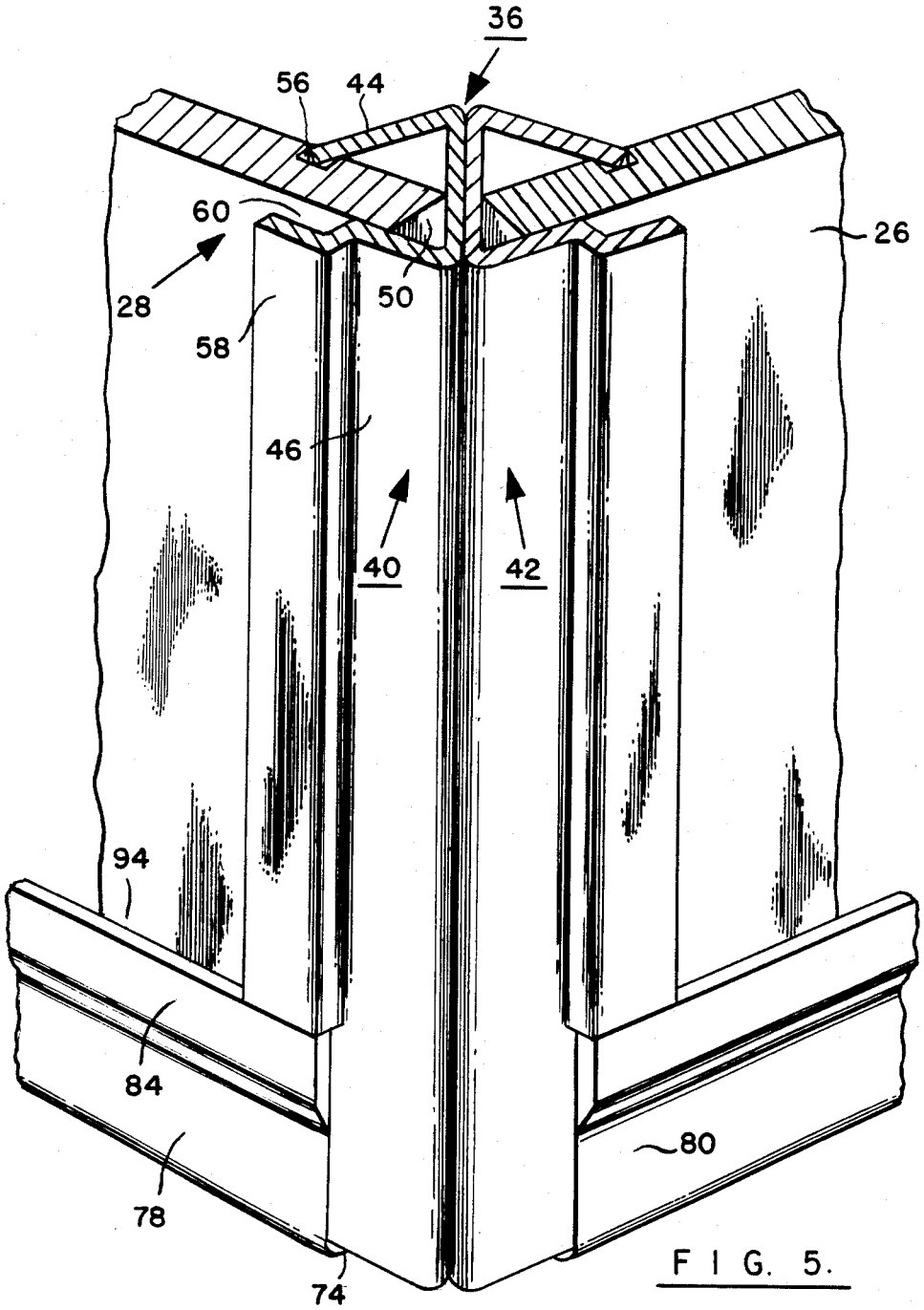
FIG. 5 is a fragmentary perspective showing the details of a bottom corner of the display section of the unit.

FIG. 5 shows a lower corner of a fully assembled display section. Retaining strip 58 on post element 40 terminates just above the upper edge of sheet-retaining strip 84. A similar relationship between sheet-retaining strips exists at all four corners of each panel, so that there is a substantially continuous sheet-retaining channel extending around the perimeter of each panel. For example, channel 60, between strip 58 and panel 28, is substantially continuous with channel 94, between strip 84 and panel 28. Flange 46 of post element 40 and the corresponding flange of post element 42 extend behind flanges 78 and 80 respectively, and their lower ends rest on the top surface of triangular panel 74.

Figure 6:
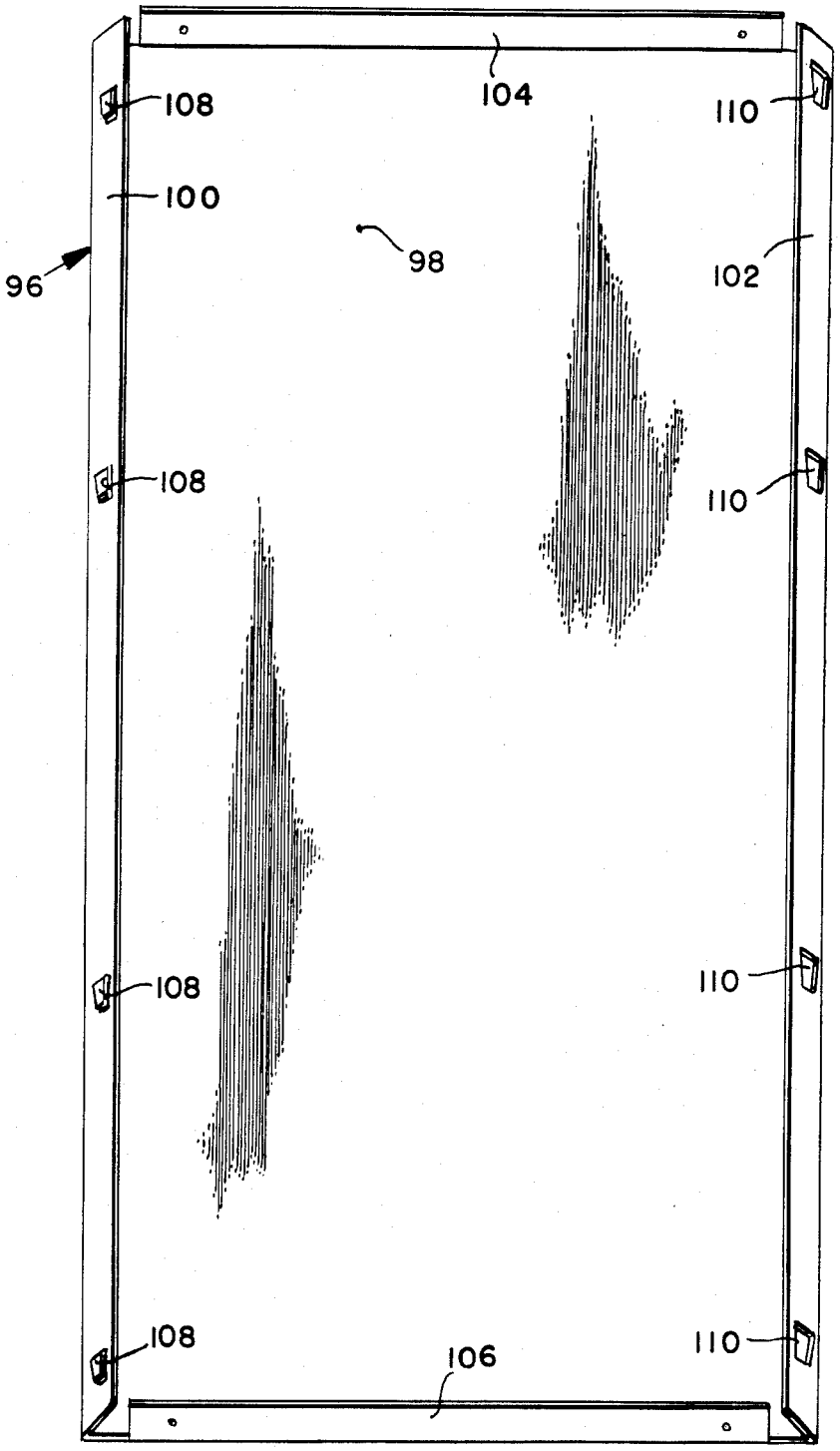
FIG. 6 is a perspective view of a panel of a three-panel triangular pedestal.

FIG. 6 shows panel 96, one of three identical panels making up the pedestal of the display unit. Panel 96 is generally rectangular in shape, and comprises an elongated rectangular plane section 98 having flanges 100 and 102 extending along its long edges. Flanges 100 and 102 are both on the same side of the plane of section 98, and are bent inwardly, forming 30° angles with the plane of section 98. The shorter edges of section 98 are formed with perpendicular flanges 104 and 106, both located on the same side of the plane of section 98 as are flanges 100 and 102. A series of struck-out hook tabs 108 is formed in flange 100, the hook tabs being downwardly open and being located on the outer side of flange 100. Four hook tabs 108 are formed in a typical panel. However the number of tabs can be varied depending on the size of the panel. The hook tabs are trapezoidally shaped and downwardly tapered. Trapezoidally shaped and downwardly tapered holes 110 are formed in flange 102. Each hook tab 108 has a corresponding hole 110. The narrow lower edges of holes 110 are just slightly wider than the upper edges of the hook tabs. Furthermore, the lower edges of the holes are positioned almost directly opposite the upper edges of the tabs so that, when the tabs of one panel are engaged with the holes of an adjacent identical panel, the upper flanges of both panels (corresponding to flange 104) are at the same level.

Three identical panels are engaged to form a rigid sheet metal pedestal in the manner illustrated in FIG. 7. The pedestal consists of three identical panels 24, 96 and 118. Flange 116 of panel 118 is engaged with flange 102 of panel 96. Flange 120 of panel 118 is engaged with flange 122 of panel 24. The engagement of flanges 102 and 116, and of flanges 120 and 122 is accomplished simply by causing the tabs of one flange to enter the holes of the adjacent flange, and effecting relative vertical sliding movement to lock the panels together. Because the panels are identical, panel 96 is moved upwardly with respect to panel 118 to effect locking, whereas panel 24 is moved downwardly with respect to panel 118 to effect locking. Stated in more general terms, the required relative movement, for engagement of the flanges along both edges of any given panel face with overlapping adjacent flanges, is such that the adjacent flanges move in opposite directions relative to the given panel face. Engaging the final pair of flanges, namely flanges 112 and 100, requires a twisting movement. With the structure, as shown in FIG. 7, in its relaxed condition, the lower edge of hole 14 in flange 112 is at approximately the same level as the upper edge of the nearest hook tab 108. Consequently, the entire structure must be twisted to permit the hook tab to enter hole 114. This is accomplished by pushing flange 112 downwardly, or by pushing flange 100 upwardly, and at the same time bringing the flanges together so that the hook tabs enter their corresponding holes. The flanges are then slid relative to each other in the direction opposite to the direction of relative movement which took place during the twisting movement. This causes the hook tabs 108 to engage flange 112, fastening flanges 100 and 112 together. A constant locking pressure is applied to the tabs and holes when the pedestal is fully assembled, and it will not come apart during normal handling during the assembly of the kiosk.

The sizes and shapes of the hook tabs and the openings accommodates the slight misalignment of the flanges when the structure is twisted. That is, flanges 112 and 100 can move slightly out of parallelism with each when the twisting force is applied, yet the hook tabs can be made to enter their corresponding openings without difficulty, because the openings are larger than the hook tabs. Nevertheless, because of the trapezoidal shapes of the tabs and holes, and particularly because the lower edges of the holes are of approximately the same length as the upper edges of the tabs, horizontal translation of the joined flanges is prevented when the flanges are finally fastened together, and a very rigid structure results.

Holes 124 and 126 in the flanges at the upper end of the pedestal structure receive sheet metal screws extending downwardly through holes 92 (FIG. 4) in the bottom element 30 of the display section. Similarly, holes 128 and 130 receive sheet metal screws extending downwardly through holes 88 in element 30, and holes 132 and 134 receive sheet metal screws extending downwardly through holes 90 in element 30. The pedestal is similarly attached to the hexagonal base by sheet metal screws which extend upwardly through holes in the base into flanges at the bottom of the pedestal structure. The cross-sections of the pedestal and of the display section are generally in the form of equilateral triangles rotationally displaced from each other by 120°.

The procedure for assembly of the display unit is preferably as follows. First, the pedestal 14 is formed by assembly of the three identical panels in the manner depicted in FIG. 7. Next, base 12 is secured to the pedestal with sheet metal screws. Then, bottom panel 30 of the display section is secured to the top of the pedestal with sheet metal screws. Post elements are secured together in pairs by relative sliding to provide three identical posts. Posts are attached to opposite edges of a first display panel, and second and third display panels are inserted into the posts just attached to the first display panel. Then, a third post is attached to the opposite edges of the display panels by engaging the ends of its tongues with grooves in the display panels and then sliding the post longitudinally so that its tongues slide in the grooves and thereby become fully engaged with the grooves. Top element 32 (FIG. 1) is then secured to the panel and post assembly. The attachment to the panels is made by the insertion of screws into the panels through holes corresponding to holes 93 in FIG. 4. Finally, the assembly of panels, posts and top element is placed on bottom element 30, and secured by screws which extend through holes 93 (FIG. 4) into the panels.

Figure 8:
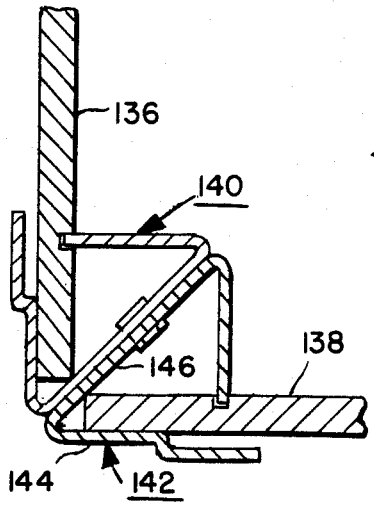
FIG. 8 is a fragmentary horizontal section through a corner of a four-sided display section in accordance with a first alternative embodiment of the invention.

While the assembly just described consists of a triangular display section and a triangular pedestal, numerous other configurations can be used. For example, FIG. 8 shows a corner of a four-sided display section comprising panels 136 and 138 which are perpendicular to each other. The post consists of post elements 140 and 142 which are identical. Post element 142 comprises a panel-retaining part 144, and a connecting part 146 disposed at an angle of 45° relative to each other. Tongues of the post elements engage grooves in the panels in a manner similar to that already discussed with reference to the three-sided display section.

Figure 9:
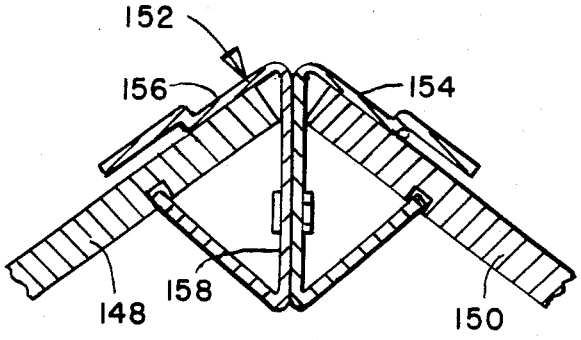
FIG. 9 is a horizontal section through a corner of a five-sided display unit in accordance with a second alternative embodiment of the invention.

FIG. 9 shows a corner of a five-sided display section comprising panels 148 and 150, and post elements 152 and 154. Panels 148 and 150 are disposed at an angle of 108° relative to each other. Panel-retaining element 156 of post element 152 is disposed at an angle of 54° relative to connecting element 158.

The structure in FIG. 8 forms an equilateral four-sided display, and the structure in FIG. 9 forms an equilateral pentagonal display. With appropriate post elements, the displays can have any number of sides. The angle between the panel-retaining flange of the post element and the connecting web of the post element should be such that the connecting webs bisect the corner of the display. In the case of an equilateral display, the angle C between the panel-retaining flange and the connecting web of the post element should be in accordance with the formula $$C=90(1-2/N)$$

where N is the number of sides of the display.

Figure 10:
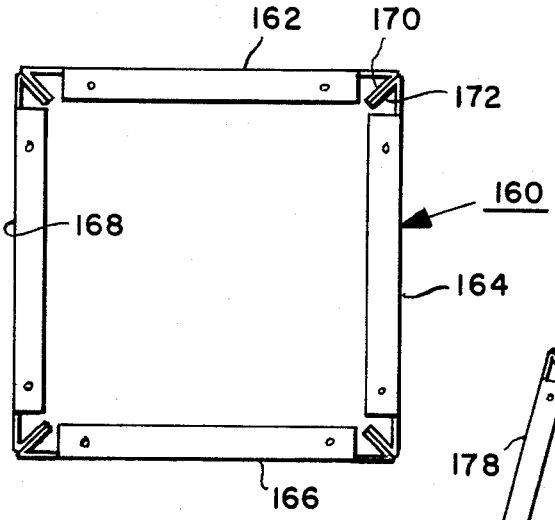
FIG. 10 is a top plan view of a four-panel pedestal in accordance with the first alternative embodiment of the invention.

The number of sides of the pedestal can be varied also. Pedestal 160 in FIG. 10 is rectangular and comprises four identical panels 162, 164, 166 and 168. The flanges which interconnect the panels at the corners of the pedestal are disposed at 45° with respect to the panel faces. Flanges are indicated in FIG. 10 at 170 and 172.

Figure 11:
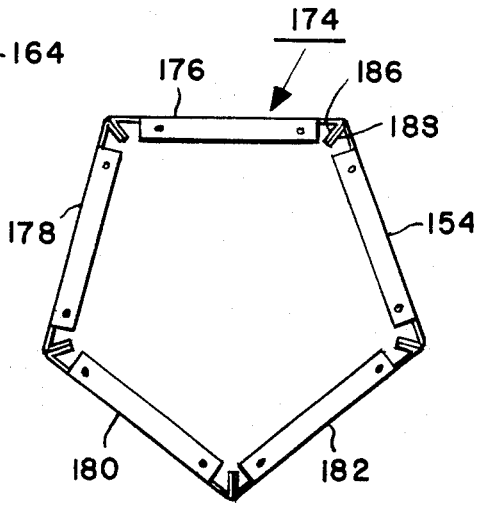
FIG. 11 is a top plan view of a five-panel pedestal in accordance with the second alternative embodiment of the invention.

A pentagonal pedestal is shown in FIG. 11 consisting of five identical panels 176, 178, 180, 182 and 184. The flanges of this pentagonal display which interconnect the panels are disposed at angles of 54° relative to the panels. Two such flanges are indicated 186 and 188. The formula for determining the flange angles in an equilateral pedestal is the same formula used to determine the angles between the panel-retaining flanges and connecting webs of the post elements in an equilateral display section.

It is even possible to take advantage of some of the principles of the invention in a two-part pedestal, provided that the parts are not planar panels. For example a pedestal in accordance with the invention could consist of two identical semi-circular flanged elements.

Numerous other modifications can be made to the display section and to the rigid sheet metal structural element constituting the pedestal, without departing from the scope of the invention as defined in the following claims.

I claim:

1. A rigid sheet metal structural element comprising:

a plurality of sheet metal panels, each panel having a face with two opposite straight edges, said edges being parallel to each other, and flange, integrally formed on the panel, at each edge;

the panels being arranged with each flange of each panel overlapping a flange of a next adjacent panel to form an overlapping pair of flanges, and with each of said straight edges of each face meeting one of said straight edges of the next adjacent panel in close parallel relationship to form a hollow structure, the cross-sections of which, in planes to which said edges are perpendicular, are closed upon themselves;

the flanges of each overlapping pair having interengaging means formed thereon for preventing the overlapping flanges from separating from each other, the interengaging means requiring a relative sliding movement of the two flanges of each overlapping pair, parallel to said straight edges, for engagement of the flanges, the required relative movement, for engagement of the flanges along both edges of any given panel face with overlapping adjacent flanges, being such that the adjacent flanges move in opposite directions relative to said given panel face.

2. A structural element according to claim 1 in which said interengaging means prevent all relative movement of the flanges of a fully engaged pair except in a direction opposite to the direction of required relative movement for engagement.

3. A structural element according to claim 1 in which the plurality of sheet metal panels comprises at least three panels.

4. A structural element according to claim 1 in which all of the panels in said plurality of sheet metal panels are substantially indentical.

5. A structural element according to claim 1 in which all of the panels in said plurality of sheet metal panels are substantially identical, and in which the flanges on each panel extend toward the same side of the face.

6. A structural element according to claim 1 in which all of the panels in said plurality of sheet metal panels are substantially identical, in which the flanges on each panel extend toward the same side of the face, and in which the flanges of each panel meet the face thereof at acute angles, and the flanges are located within the interior of the hollow structure.

7. A structural element according to claim 1 in which the flanges on each panel extend toward the same side of the face.

8. A structural element according to claim 1 in which the flanges on each panel extend toward the same side of the face and in which the flanges of each panel meet the face thereof at acute angles, and the flanges are located within the interior of the hollow structure.

9. A structural element according to claim 1 in which the faces of all of the panels in said plurality of sheet metal panels are substantially planar and in which the plurality of sheet metal panels comprises at least three panels.

10. A structural element according to claim 1 in which the number of panels in said plurality of panels is three.

11. A structural element according to claim 1 in which the panels in said plurality of sheet metal panels are substantially identical, and in which the interengaging means on each panel comprise a series of openings formed in one of the flanges thereof and a series of hook tabs formed on the other flange thereof, the hook tabs being positioned to fit through the openings in one of the flanges of a next adjacent panel and to fasten the panels together upon said relative sliding movement.

12. A structural element according to claim 1 in which the interengaging means on each panel comprise a series of openings formed in one of the flanges thereof and a series of hook tabs formed on the other flange thereof, each of the hook tabs being positioned to fit through one of the openings in one of the flanges of a next adjacent panel and to lock the panels together upon said relative sliding movement, each opening being substantially trapezoidal in shape and tapered in a direction parallel to said opposite straight edges of its panel, and each hook tab also being substantially trapezoidal in shape and being tapered in the same direction as the corresponding opening which it fits through, and the trapezoidal outline of each hook tab being substantially smaller than the trapezoidal outline of its corresponding tapered opening, and the wider end of each hook tab being attached to its flange and being of substantially the same width as the narrow end of its corresponding opening, whereby the hook tabs are capable of entering their corresponding openings freely when the flanges being attached to each other are misaligned due to twisting of the structural element, yet the flanges, when fully engaged, are prevented from all relative movement except in a direction opposite to the direction of required relative movement for engagement.

13. A display unit comprising a panel having at least one substantially straight elongated edge, and a rigid post element secured to said elongated edge, wherein the panel has a pair of opposite faces and an elongated groove in one of said faces extending in a direction parallel to said edge and spaced therefrom, and wherein the post element comprises a tongue, elongated in a direction parallel to said elongated edge, and received in said groove, and a panel-retaining element connected to the tongue and engaged with the other of said faces of the panel, the display unit including means engaged with a part of the panel remote from said groove and on the side of the groove remove from said edge of the panel, for preventing the panel from rotating relative to the post element, about an axis in the vicinity of the post element and parallel to said elongated edge, in a direction such that the tongue of the post element disengages from the groove of the panel.

14. A display unit according to claim 13 in which said panel-retaining element includes a strip means spaced away from the face of the panel engaged by the panel-retaining element by a short distance to provide, in cooperation with said face of the panel, a retaining channel for sheet material positioned against said face of the panel.

15. A display unit according to claim 13 in which the tongue extends toward said groove from a location spaced from said one of said faces of the panel, in which the panel-retaining element is connected to the tongue by a connecting element extending from said location around said edge of the panel to said panel-retaining element, in which at least a part of said connecting element extending between said tongue and said edge of the panel is spaced from said one of said faces of the panel, and including means on said connecting means, for securing the post element to another post element.

16. A display unit comprising at least three substantially identical panels, each having a pair of substantially straight, parallel opposite edges, the panels being arranged to form a hollow structure the cross-sections of which, in planes to which said edges are perpendicular, are closed upon themselves, with each of said edges of each panel closely approaching and extending substantially parallel to one of said edges of another of said panels to provide said hollow structure with corners, wherein each panel has an inside face disposed toward the inside of the hollow structure and an opposite outside face, and each panel has a pair of elongated grooves on its inside face, a first of said grooves being located adjacent and parallel to, but spaced from, one of said edges of the panel and the second of said grooves being located adjacent and parallel to, but spaced from, the other of said edges of the panel, and including a rigid corner post at each corner location at which the said edges of a pair of said panels closely approaches each other, each post comprising a first elongated tongue received in a groove of one panel of its pair of panels, a first panel-retaining element, connected to said first elongated tongue, and engaged with the outside face of said one panel, a second elongated tongue received in a groove of the other panel of said pair of panels, and a second panel-retaining element, connected to said second elongated tongue, and engaged with the outside face of said other panel.

17. A display unit according to claim 16 in which each of the rigid corner posts comprises first and second post elements, the first post element including said first elongated tongue, said first panel-retaining element and first web means connecting said first tongue and said first panel-retaining element, the second post element including said second elongated tongue, said second panel-retaining element and second web means connecting said second tongue and said second panel-retaining element, and first and second post elements being rigidly connected to each other.

18. A display unit according to claim 16 in which each of the rigid corner posts comprises first and second post elements, the first post element including said first elongated tongue, said first panel-retaining element and first web means connecting said first tongue and said first panel-retaining element, the second post element including said second elongated tongue, said second panel-retaining element and second web means connecting said second tongue and said second panel-retaining element, the first and second post elements being rigidly connected to each other by interengaging tabs and slots in said first and second web means.

19. A display unit according to claim 16 in which each of the rigid corner posts comprises first and second substantially identical post elements, the first post element including said first elongated tongue, said first panel-retaining element and first web means connecting said first tongue and said first panel-retaining element, the second post element including said second elongated tongue, said second panel-retaining element and second web means connecting said second tongue and said second panel-retaining element, the first and second web means having substantially planar sections which abut each other in a plane which bisects the angle between the inside faces of the panels at the corner of the hollow structure at which said first and second post elements are situated, each of said first and second web means having both hook tabs and slots, the hook tabs of each web means engaging the slots of the other to fasten the post elements rigidly together.

20. A display unit according to claim 16 in which the angle between the inside face of the panels at each corner of the hollow structure is equal to the angle between the inside faces of the panel at every other corner of the hollow structure.

21. A display unit according to claim 16 in which the first panel-retaining element engages the outside face of said one panel at least at a location thereon closer to the edge of said one panel at said corner than the distance between the last-mentioned edge and the adjacent groove of said one panel, and in which the second panel-retaining element engages the outside face of said other panel at least at a location thereon closer to the edge of said other panel at said corner than the distance between the last-mentioned edge and the adjacent groove of said other panel.

* * * * *